United States Patent [19]

Fenton

[11] 4,231,222

[45] Nov. 4, 1980

[54] AIR FUEL CONTROL SYSTEM FOR STIRLING ENGINE

[75] Inventor: James E. Fenton, Ann Arbor, Mich.

[73] Assignee: Ford Motor Company, Dearborn, Mich.

[21] Appl. No.: 943,593

[22] Filed: Sep. 18, 1978

[51] Int. Cl.[3] ..... F02G 1/04

[52] U.S. Cl. ..... 60/524

[58] Field of Search ..... 60/524, 517; 364/431; 123/139 AT; 239/536; 73/118

[56] References Cited

U.S. PATENT DOCUMENTS

| | | | |
|---|---|---|---|
| 2,617,478 | 11/1952 | Hildestad | 239/536 X |
| 3,956,892 | 5/1976 | Nystrom | 60/524 |

*Primary Examiner*—Jerry W. Myracle

*Attorney, Agent, or Firm*—Joseph W. Malleck; Olin B. Johnson

[57] ABSTRACT

An air/fuel control system (including apparatus and method for a Stirling engine is disclosed. A signal generated by deviation of the temperature of the heater head gas temperature from a set-point is used to control an air flow throttle valve. Variations in the air flow of the external combustion circuit is sensed by way of a vortex-shedding device which delivers a D.C. electrical signal. The signal is shaped and amplified and used to control operation of one or more fuel injectors which feed into a common outlet manifold leading to the fuel nozzle serving the external combustion circuit. The fuel injectors are solenoid operated, one sized to provide a fuel flow rate of 0.4–2.0 g/sec., and at least two others are sized to provide a combined fuel flow rate of 2–15 g/sec., but 180° out of phase with each other. The series of injectors provide an effective fuel control range of 0.4–15 grams/sec. to achieve an air/fuel ratio range of 37.5 to 1.

10 Claims, 7 Drawing Figures

P-V Diagram-Ideal Sterling Cycle

T-S Diagram-Ideal Sterling Cycle

943593

AIR FUEL CONTROL SYSTEM FOR STIRLING ENGINE

BACKGROUND OF THE INVENTION

The Stirling engine derives energy from a continuous external combustion process. All of the heat supplied from the combustion process has to be transferred through metal walls (heater tubes) to a pressurized hydrogen working fluid. The pressure-volume (P-V) and temperature-entropy (T-S) diagrams of the ideal Stirling cycle help in understanding the derivation of power for the engine. These diagrams (see FIGS. 6 and 7) illustrate that heat is transferred to the working fluid during the constant-volume phase 2-3 and during the isothermal expansion phase 3-4. Heat is rejected during the constant-volume phase 4-1 and during the isothermal compression phase 1-2. During the isothermal expansion of phase 3-4, heat addition occurs at the same rate at which work is produced by the fluid expansion. Therefore, to maintain maximum possible power out of the engine, the temperature of the working fluid must be maintained at a constant level and as high as possible, taking into consideration the metallurgical heat limit of the materials. Typically, a Stirling engine designed for automotive use is optimized for a hydrogen temperature of 710° C. or higher.

An air/fuel control system is required to maintain such a constant hydrogen temperature. Such control system should also be capable of varying the ratio between air and fuel in response to a change in engine load, and also to provide a change in the air/fuel ratio as a function of fuel flow which may be varied as a result of exhaust gas recirculation. Air flow itself is a variable commodity since it is generated by a blower which is engine driven after the engine has been started. The air/fuel control system thus must respond to at least three superimposed parameters.

Varying the air/fuel ratio is necessary, apart from the desire to seek a constant hydrogen temperature, to control exhaust emissions and to improve engine efficiency. Unburned hydrocarbons in the exhaust, due to a rich fuel mixture, represent an energy loss; however, an air rich mixture results in less efficient heat transfer, and, therefore, a less efficient heating system. Varying amounts of exhaust gas recirculation (EGR) is required for dilution and to reduce the generation of nitrogen oxide emissions.

The prior art has attempted to provide an air/fuel control system for an automotive Stirling engine principally according to two concepts: (a) a closed loop system wherein the sensed hydrogen temperature was used to directly control a fuel metering device; or (b) an open loop system wherein a sensed change in the hydrogen temperature was utilized to control an air flow throttle valve which would modulate air flow, and then a fuel metering system was operated in response to a change in the air flow. The closed loop control system has proven deficient in spite of the fact that the fuel metering device employed dual pumps for improving the range of air/fuel ratios that could be administered. This resulted principally from low flow stability in the fuel injection rate range of 0.4–0.9 grams per second. Such system also required a motor which would operate the fuel injection device while operating at a constant low rpm; this was difficult to devise.

Open loop control systems have experienced comparable problems. One system employs a hydro-pneumatic fuel metering device responsive to an air flow measuring device consisting of a spring loaded flapper and a specially designed orifice. The flapper valve is located in the air inlet system between the air cleaner and the air throttle valve. The air flow signal is transmitted to a signal amplifier and it is designed so that the pressure drop in the device is proportional to the two-thirds power of air flow. This fuel metering assist is deficient because it is unable to compensate for the hysteresis of the open loop metering, and is not able to operate over a broad enough air/fuel range required of the engine. Another metering device typically used with the open loop system is a spool valve which in certain positions can bypass fuel. This latter device is not able to operate with a broad enough air/fuel ratio range.

SUMMARY OF THE INVENTION

A primary object of this invention is to provide an improved air/fuel control system for a Stirling engine adapted for automotive use, the system being characterized by the ability to operate accurately over a considerably wider range of air/fuel ratios.

A detailed object of this invention is to provide an air/fuel control system which is effective to vary the air flow in response to temperature changes in the heater head of a Stirling engine, and then to vary fuel introduction in response to a change in the air flow, the variation in fuel introduction being able to meet a fuel range as broad as 0.4–15 grams per second.

Another object of this invention is to provide an air/fuel control system of the open-loop type which eliminates hysteresis of the fuel metering function in response to a change in air flow.

Yet another object of this invention is to provide an air/fuel control system for a Stirling engine which employs an air sensing system linearly proportional to variations in air flow normally experienced by Stirling engines.

Yet, still another object of this invention is to provide an air/fuel control system which additionally provides for the shutting off of fuel introduction during deceleration of the engine and at the same time provides for shutting off of fuel during an excessively high hydrogen temperature condition which normally would occur during part of the engine deceleration.

Features pursuant to the above objects comprise:

(a) the use of an air sensing device which operates on a vortex shedding principal wherein the cooling effect upon a sensing rod stimulates an electrical signal responsive to the amount of vortex flow present in the fluid engaging said rod; (b) the use of a fuel metering device which employs at least three fuel injectors placed in parallel and deriving fuel from a common fuel manifold, each injector functioning to inject fuel by way of a fuel nozzle into a common exit manifold, and (3) an electronic shaping circuitry which is effective to take the pulse output signal of the air flow sensor and process it to provide a signal strong enough and in proper form to control the fuel injectors.

DETAILED DESCRIPTION

Figure 1:
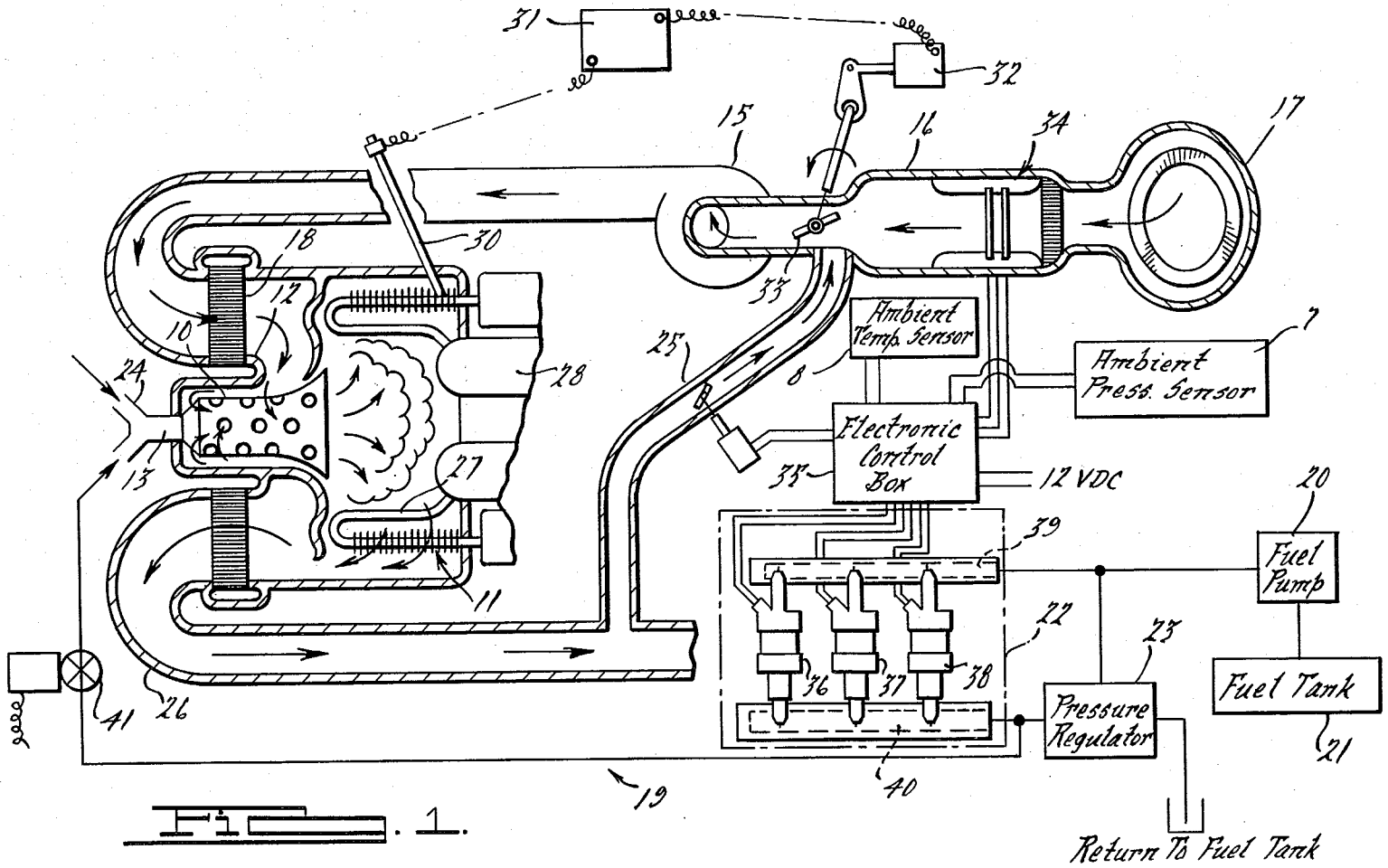
FIG. 1 is a schematic diagram of a Stirling engine and associated air/fuel controls embodying the invention hereof.

Turning first to FIG. 1, the Stirling engine has a thermodynamic cycling mechanism from which work energy is extracted, such cycling apparatus requiring the input of a continuous supply of heat. To this end, a combustor or burner unit 10 located at the end of a heater head 11 is supplied with both air (from passage 12) and fuel (from nozzle 13) which is ignited in the combustor. The air supply system 14 is comprised of an air blower 15 which sucks air through a delivery unit 16 having an air filter and silencer 17 at its far end. The driven air is delivered to a recuperator device 18 which transfers heat to the incoming air before it enters the burner unit. A fuel supply system 19 is provided which has a fuel pump 20 drawing a suitable quantity of fuel from a fuel tank 21 which is thence metered by an apparatus 22 (requiring pressure regulation by unit 23) and delivered to the atomizing nozzle where it is mixed with air from supply 24 and the burner unit containing air supplied from passage 12. Additionally, a fuel and air supply may be further introduced by way of exhaust gas recirculation employing a passage 25 interconnecting the exhaust system 26 and the air supply system 14 (immediately upstream from blower 15). The exhaust gases which, if containing a sufficient amount of oxygen and unburned fuel, are recirculated to a portion of the suction side of the air blower and permitted to mix with the incoming air.

The combusted hot gases within the heater head 11 transfer heat units to a pressurized hydrogen working fluid operating in a closed system 27 in a known manner of the Stirling cycle to power pistons in cylinder 28.

A control system for the air fuel sypply system requires measurement of hydrogen temperature in the heater head, measurement of air flow, and control of fuel, air and EGR in response thereto. The heater head hydrogen temperature is measured by a thermocouple 30 inserted into the heater tubes of system 27. This measurement signal is processed electronically in unit 31 where, after amplification, it is compared to a reference voltage, representing the desired hydrogen temperature; the difference in voltage is used to operate a positioning motor 32 which in turn operates an air control valve 33.

Air flow is selected because it is dependent on blower speed, which in turn is dependent on engine speed, the latter responding more slowly to a demanded change than fuel flow. This assists in reducing the hysteresis of the control cycle. Fuel flow is needed to follow in the desired air/fuel ratio in response to a change in air flow.

The control aspects of the fuel supply system is comprised of an air flow measuring device 34, an electronic control module 35, fuel metering apparatus 22 having three fuel injectors (36, 37 and 38) mounted between common inlet manifold 39 and common outlet manifold 40, and the fuel pump 20 and a pressure regulator 23. A fuel safety shutoff valve 41 is used downstream of apparatus 22. The air flow measuring device senses the volumetric flow, the temperature, and the pressure of the incoming air. The output signal of the air flow measuring device has a frequency proportional to mass air flow. It is sent to the electronic control box where the pulse is converted to a direct current signal used to control both the pulse width and the switching points of the three fuel injectors.

Figure 2:
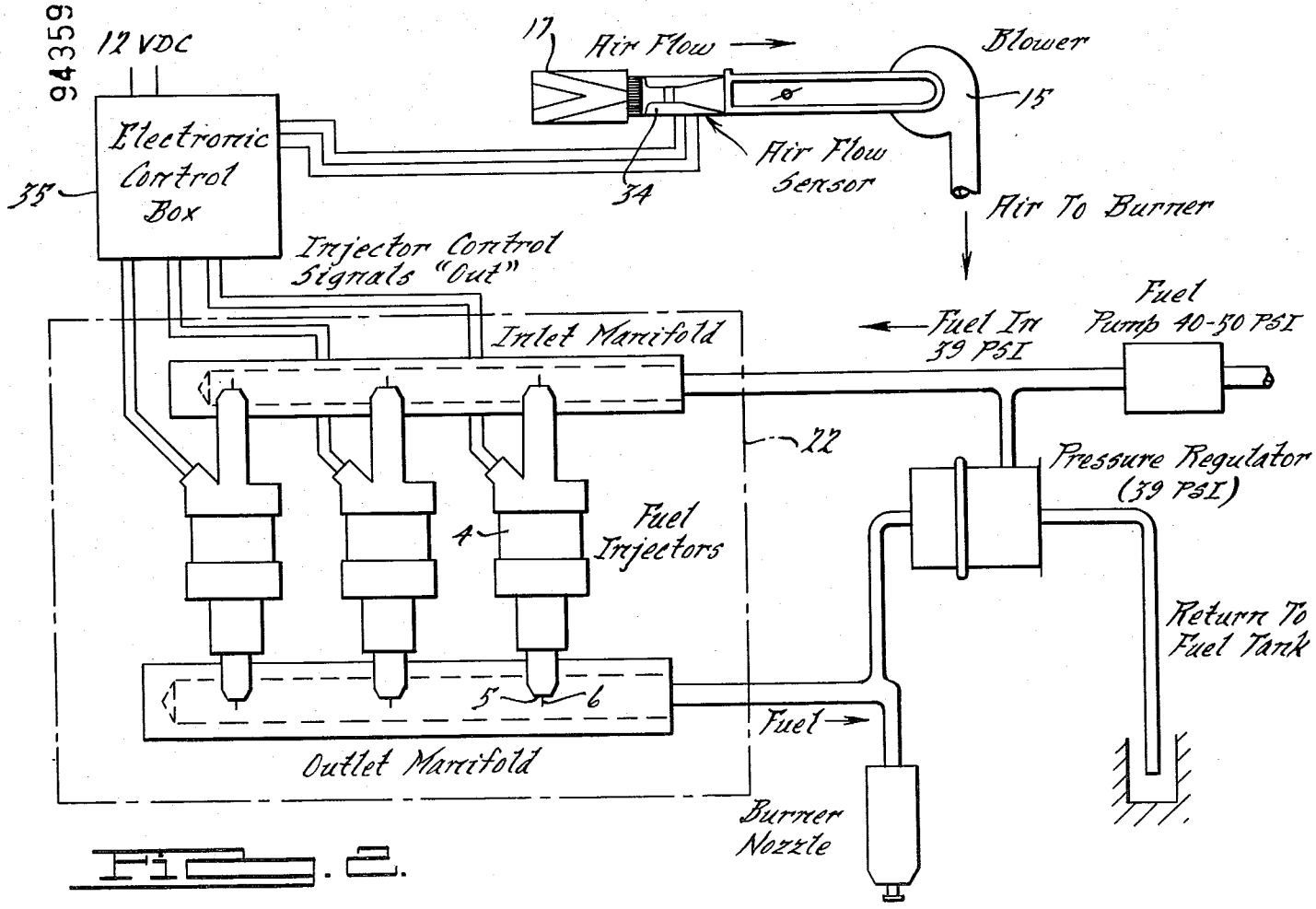
FIG. 2 is an enlarged view of a portion of the air/fuel control system shown in FIG. 1.
Figure 3:
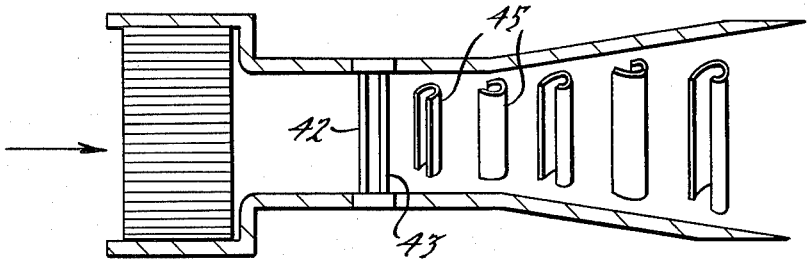
FIG. 3 is an enlarged view of the schematic air flow sensor device forming part of the structure of FIG. 1.
Figure 3A:
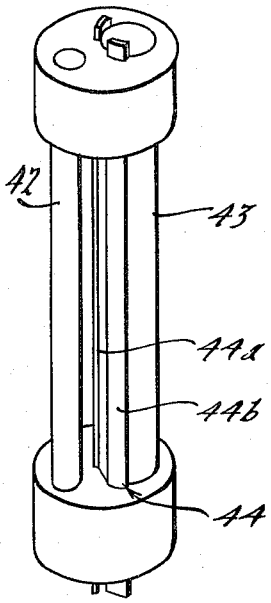
FIG. 3*a* is an enlarged perspective view of one of the air flow sensing rods.
Figure 4:
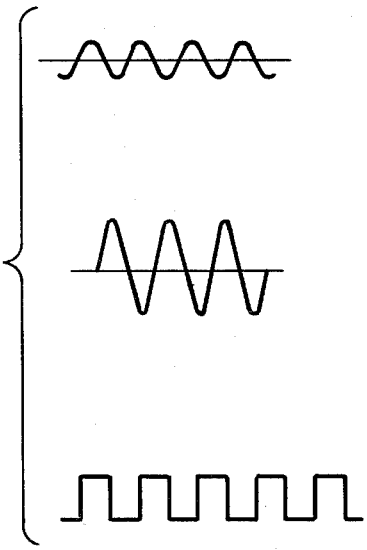
FIG. 4 is a composite view illustrating the sequence of wave shapes forming the signal as modified by the electronic shaping circuitry.
Figure 6:
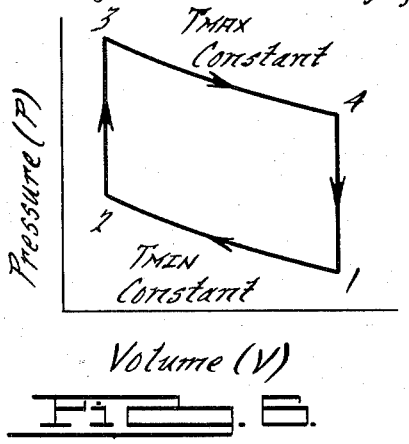
FIGS. 6 and 7 are graphical illustration of engine parameters for an ideal Stirling cycle.
Figure 7:
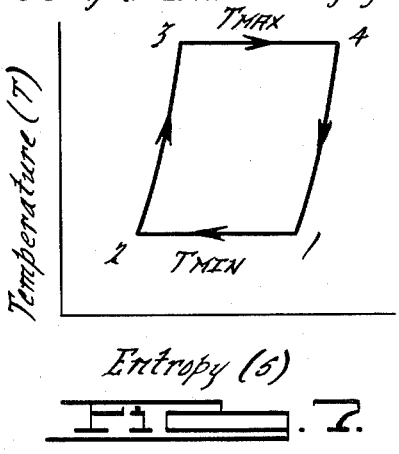

Turning now, in particular to FIGS. 2–3, the air flow measuring device has a sensor constructed to utilize a vortex shedding phenomenon. A two-rod system (42 and 43) is used, with the upstream rod 42 generating vortices 45 in the air stream, as shown in FIG. 3. The vortex frequency is proportional to air velocity (and volume), and is detected by a thermosensor 44 (comprised of strips 44*a* and 44*b*) placed on the second rod 43 downstream from the shedder rod 42. The two nickel sensing strips (44*a* and 44*b*) are placed on the second or glass sensing rod 43 in a position such as to react to the vortices which are generated alternately on each side of the upstream rod. The second downstream rod reacts to the cooling effect of these vortices on its two self-heated nickel-on-glass elements. These elements are connected in an electrical bridge arrangement to eliminate common mode factors. The output of thermosensor 44 is a vortex frequency resistance variation created by the heating and cooling of the nickel elements. A D.C. current through the nickel elements maintains the heat, and an amplifier boosts the millivolt signal generated at the bridge output. The amplified sinusoidal frequency then goes through a circuit in the electronic control unit 35 that gives a square wave pulse output signal (see modification in FIG. 4). The ambient temperature signal (from Sensor 8) and ambient pressure signal (from sensor 7) are applied by circuit 9 in the control box to the volumetric signal to produce a frequency proportional to mass flow.

Figure 5:
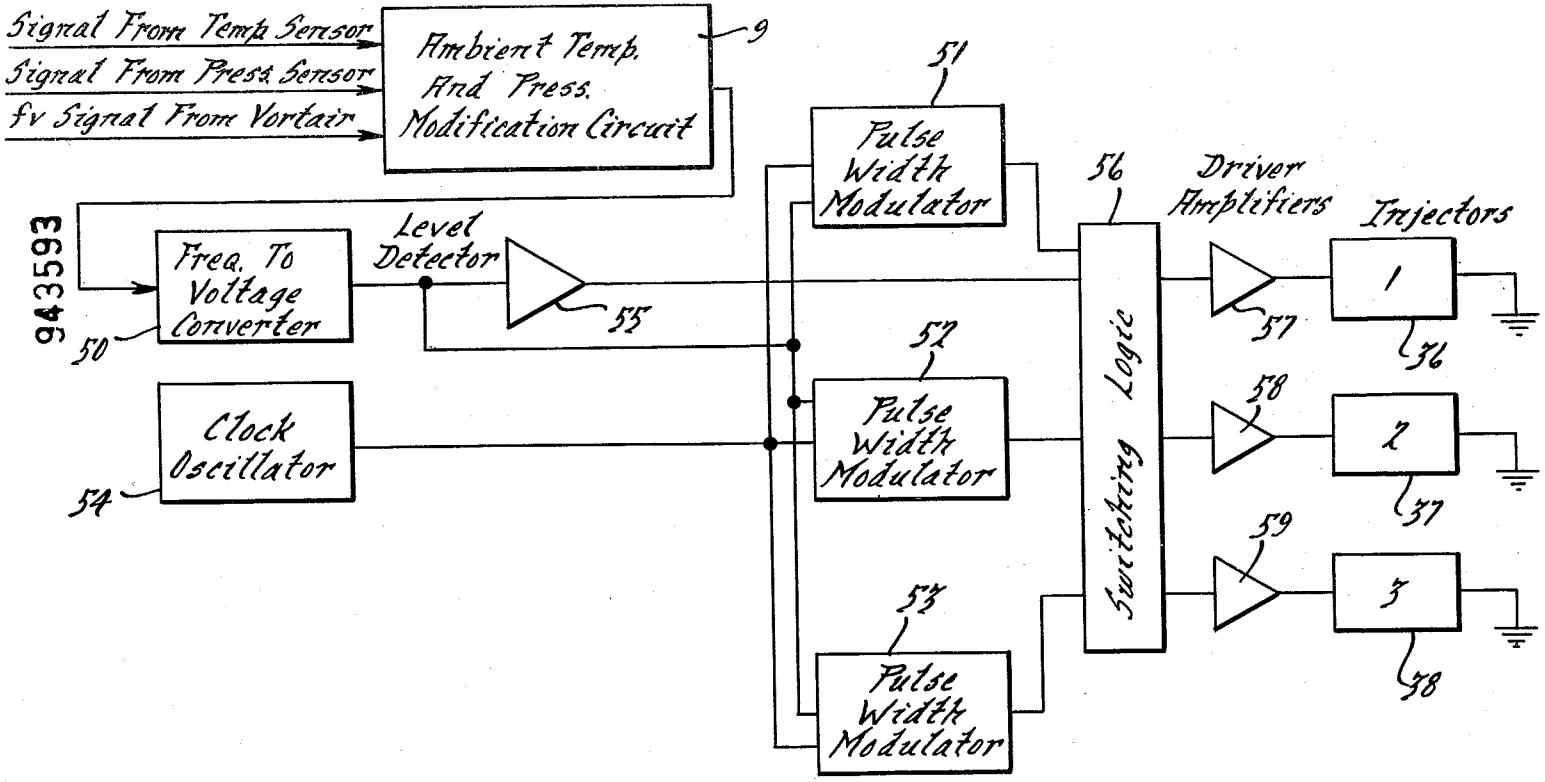
FIG. 5 is a schematic block diagram of the electronic shaping circuitry useful in the structure of FIG. 1.

FIG. 5 presents a block diagram showing how the pulse output signal from the air flow sensors is processed for control of the drive signal to the series of three fuel injectors (36, 37, 38). The pulse is changed to a D.C. level signal by a frequency to voltage converter 50. This D.C. level signal proportional to air flow, is applied to width modulators 51, 52, 53 associated with each injector. Each pulse modulator has a clock signal input from a clock oscillator 54 which sets the repetition rate. This determines how many times per second the injectors will be turned on. The air flow signal determines the pulse width through the action of the pulse width modulators. This determines how long the injectors are turned on. The output of a level detector 55 is fed to a switching logic unit 56 along with the output of the pulse width modulators (51, 52, 53) and the logic circuit therein determines which of the injectors is to be turned on at any one moment. Driver amplifiers 57, 58, 59 boost the low level output of the switching logic to a high level current pulse for operating the solenois injectors (36, 37, 38).

The metering apparatus 22 has three electrically actuated solenois fuel injector valves. Each consists of essentially a tapered pin 6 and tapered orifice 5; the pin being normally biased to close the orifice. A solenoid winding 4 is energized to withdraw the pin and permit fuel flow through the orifice. Fuel floods an inlet manifold 39 in communication with the inlet ports of each injector. The pressure of the fuel in the inlet manifold is maintained at a constant pressure of about 39 p.s.i. One or more of the injector valves are turned on during engine operation, since the Stirling cycle requires a continuous external combustion circuit. Thus, the fuel flow in the output manifold 40 will vary, but still have a pressure of 39 p.s.i. One of the three injectors has a smaller flow orifice and covers the flow rage of 0.4–2 grams per second. The other two, operating together but 180° out of phase, cover the flow range of 2–15 grams per second. preferably, fuel injector 36 is sized to provide a fuel flow of 0.4 to 2.0 g/sec., injector 37 of 1.0 to 7.5 g/sec. and injector 38 of 1.0 to 7.5 g/sec. The injectors have combined metering and atomizing orifices, which serve only as a metering valve. In this manner, a cascaded addition or subtraction of their combined fuel flows will give the required fuel metering range.

The time constant of the fuel metering system is electronically controllable allowing the matching of the air flow measurement device time constant to provide an accurate predetermined air/fuel ratio in the combustor during transient operation.

What is claimed is:

1. In an apparatus for maintaining the temperature of a heater head of a hot gas engine at a substantially constant temperature, the engine having a combustion chamber and the apparatus having a temperature responsive element giving a signal in accordance with the temperature of the heater head, said apparatus further having a servo-system governed by said signal and a regulating means including a combustion air blower driven by the engine governing the rate of delivery of combustion air from the blower operable by said servo-system, the improvement comprising:

(a) means responsive to the rate of flow of combustion air from the blower including a plurality of differentially sized fuel injectors effective to continuously introduce fuel through one or more of said injectors to the air delivered by said blower for combustion, said injectors being effective to meter fuel over a range of 0.4–15 grams per second; and (b) a pressure regulator to regulate the pressure of said fuel delivered to said plurality of fuel injectors, whereby a constant uniform pressure drop is experienced across all said fuel injectors.

2. The apparatus as in claim 1, in which said pressure regulator is actuated by a spring loaded diaphragm.

3. The apparatus as in claim 1, in which said means responsive to the rate of flow has an air flow sensing system comprising:

(a) a pair of spaced rods extending transversely across the air flow having axes aligned with the direction of said air flow, the first rod being effective to generate vortices in the flow about said first rod, the second rod having elements carrying an electric current which is varied in response to the cooling effect of the vortices generated by said first rod.

4. The apparatus as in claim 3, in which a voltage converter is employed to modify the electrical output of said second rod so that a D.C. current signal is transmitted.

5. The apparatus as in claim 3, which further includes means for shaping the signal output of said second rod, comprising:

(a) means for converting the pulse of said second rod to a D.C. signal by a frequency to voltage change, (b) a pulse width modulator for subjecting the D.C. level signal to a timed oscillator for cutting off the pulse and thereby determining how long the injectors are to be turned on, and (c) switching logic for receiving the width modulated signals and transmitting them to the fuel injectors to allow fuel to be introduced according to the width of the pulse.

6. A method of controlling the air and fuel supply to the combustor unit of a Stirling engine, comprising:

(a) sensing the temperature within the heater head of said Stirling engine, (b) increasing air flow in response to an excess over a set point temperature of said heater head, (c) generating an electrical pulse in response to the air flow rate which will vary over a range of 8 to 300 g/sec., (d) converting the electrical pulse to a D.C. level signal and modulating said signal by a timed oscillator to produce a width modulated pulse, (e) transmitting the shaped width modulated pulse to a logic means which is programmed to activate one or more of a plurality of fuel injectors feeding into a common manifold, said program providing a fuel variation range of 0.4–15 grams per second to achieve an air/fuel ratio over a range of 37.5 to 1, and (f) transmitting the signals from said logic means to said variable fuel injectors.

7. The method as in claim 6, in which the logic means is further programmed to prohibit the introduction of fuel through said fuel injectors when the engine is experiencing deceleration.

8. The method as in claim 6, in which the fuel supplied to said fuel injectors is regulated to experience a constant pressure drop across all of said plurality of fuel injectors.

9. The method as in claim 6, in which the logic means is effective to act in response to engine loading as well as a predetermined degree of exhaust gas recirculation to modify the actuation of said fuel injectors.

10. The method as in claim 6, in which the step of generating an electrical pulse in response to the air flow rate is carried out by use of a vortex shedder sensor.

* * * * *